US006711822B1

(12) United States Patent
Ginns

(10) Patent No.: US 6,711,822 B1
(45) Date of Patent: Mar. 30, 2004

(54) SINGLE ROTARY BLADE GROOMING TRIMMER

(76) Inventor: Mary K. Ginns, 2209 S. Braeswood, #33A, Houston, TX (US) 77030

( * ) Notice: Subject to any disclaimer, the term of this patent is extended or adjusted under 35 U.S.C. 154(b) by 50 days.

(21) Appl. No.: 10/142,459

(22) Filed: May 10, 2002

(51) Int. Cl.[7] ..... B26B 19/16

(52) U.S. Cl. ..... 30/206; 30/29.5; 30/43.6; 30/346.51

(58) Field of Search ..... 30/29.5, 43.6, 30/206, 346.51

(56) References Cited

U.S. PATENT DOCUMENTS

| | | | |
|---|---|---|---|
| D254,692 | S | 4/1980 | Del Re |
| 4,430,794 | A | 2/1984 | Miller |
| 4,669,189 | A | 6/1987 | Ullmann |
| 4,700,477 | A | 10/1987 | Heller |
| 4,958,432 | A | 9/1990 | Marshall |
| 4,961,262 | A | 10/1990 | Lawrence |

FOREIGN PATENT DOCUMENTS

| | | | | |
|---|---|---|---|---|
| IT | 634907 | * | 2/1962 | 30/29.5 |

* cited by examiner

*Primary Examiner*—Douglas D. Watts

(57) ABSTRACT

A single rotary blade grooming trimmer for sculpting and trimming eyebrows in an attractive arched shape. The single rotary blade grooming trimmer includes a housing with a generally L-shaped configuration having upper and lower ends, and upper and lower portions. The upper end of the housing has a rotatable shaft extending therethrough. A plurality of rotary cutting blades outwardly radiate from the rotatable shaft adjacent an outer end of the rotatable shaft. A motor for rotating the rotatably shaft is disposed the housing. A protective cover substantially covers the cutting blades. The protective cover has a plurality of spaced apart radial slots therethrough with each radial slot comprising a pair of elongate portions preferably of equal lengths. A first of the elongate portions of each slot is located on an outer face of the protective cover and a second of the elongate portions of each radial slot is located on a perimeter side wall of the protective cover.

10 Claims, 2 Drawing Sheets

SINGLE ROTARY BLADE GROOMING TRIMMER

BACKGROUND OF THEE INVENTION

1. Field of the Invention

The present invention relates to grooming trimmers and more particularly pertains to a new single rotary blade grooming trimmer for sculpting and trimming eyebrows in an attractive arched shape.

2. Description of the Prior Art

The use of grooming trimmers is known in the prior art. More specifically, grooming trimmers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,430,794; U.S. Pat. No. 4,958,432; U.S. Pat. No. 4,961,262; U.S. Pat. No. 4,669,189; U.S. Pat. No. 4,700,477; and U.S. Pat. No. Des. 254,692.

While these devices fulfill their respective, particular objectives and requirements, the aforementioned patents do not disclose a new single rotary blade grooming trimmer. The inventive device includes a housing with a generally L-shaped configuration having upper and lower ends, and upper and lower portions. The upper end of the housing has a rotatable shaft extending therethrough. A plurality of rotary cutting blades outwardly radiate from the rotatable shaft adjacent an outer end of the rotatable shaft. A motor for rotating the rotatably shaft is disposed the housing. A protective cover substantially covers the cutting blades. The protective cover has a plurality of spaced apart radial slots therethrough with each radial slot comprising a pair of elongate portions preferably of equal lengths. A first of the elongate portions of each slot is located on an outer face of the protective cover and a second of the elongate portions of each radial slot is located on a perimeter side wall of the protective cover.

In these respects, the single rotary blade grooming trimmer according to the present invention substantially departs from the conventional concepts and designs of the prior art, and in so doing provides an apparatus primarily developed for the purpose of sculpting and trimming eyebrows in an attractive arched shape.

SUMMARY OF THE INVENTION

In view of the foregoing disadvantages inherent in the known types of grooming trimmers now present in the prior art, the present invention provides a new single rotary blade grooming trimmer construction wherein the same can be utilized for sculpting and trimming eyebrows in an attractive arched shape.

The general purpose of the present invention, which will be described subsequently in greater detail, is to provide a new single rotary blade grooming trimmer apparatus and method which has many of the advantages of the grooming trimmers mentioned heretofore and many novel features that result in a new single rotary blade grooming trimmer which is not anticipated, rendered obvious, suggested, or even implied by any of the prior art grooming trimmers, either alone or in any combination thereof.

To attain this, the present invention generally comprises a housing with a generally L-shaped configuration having upper and lower ends, and upper and lower portions. The upper end of the housing has a rotatable shaft extending therethrough. A plurality of rotary cutting blades outwardly radiate from the rotatable shaft adjacent an outer end of the rotatable shaft. A motor for rotating the rotatably shaft is disposed the housing. A protective cover substantially covers the cutting blades. The protective cover has a plurality of spaced apart radial slots therethrough with each radial slot comprising a pair of elongate portions preferably of equal lengths. A first of the elongate portions of each slot is located on an outer face of the protective cover and a second of the elongate portions of each radial slot is located on a perimeter side wall of the protective cover.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new single rotary blade grooming trimmer apparatus and method which has many of the advantages of the grooming trimmers mentioned heretofore and many novel features that result in a new single rotary blade grooming trimmer which is not anticipated, rendered obvious, suggested, or-even implied by any of the prior art grooming trimmers, either alone or in any combination thereof.

It is another object of the present invention to provide a new single rotary blade grooming trimmer which may be easily and efficiently manufactured and marketed.

It is a further object of the present invention to provide a new single rotary blade grooming trimmer which is of a durable and reliable construction.

An even further object of the present invention is to provide a new single rotary blade grooming trimmer which is susceptible of a low cost of manufacture with regard to both materials and labor, and which accordingly is then susceptible of low prices of sale to the consuming public, thereby making such single rotary blade grooming trimmer economically available to the buying public.

Still yet another object of the present invention is to provide a new single rotary blade grooming trimmer which provides in the apparatuses and methods of the prior art some of the advantages thereof, while simultaneously overcoming some of the disadvantages normally associated therewith.

Still another object of the present invention is to provide a new single rotary blade grooming trimmer for sculpting and trimming eyebrows in an attractive arched shape.

Yet another object of the present invention is to provide a new single rotary blade grooming trimmer which includes a housing with a generally L-shaped configuration having upper and lower ends, and upper and lower portions. The upper end of the housing has a rotatable shaft extending therethrough. A plurality of rotary cutting blades outwardly radiate from the rotatable shaft adjacent an outer end of the rotatable shaft. A motor for rotating the rotatably shaft is disposed the housing. A protective cover substantially covers the cutting blades. The protective cover has a plurality of spaced apart radial slots therethrough with each radial slot comprising a pair of elongate portions preferably of equal lengths. A first of the elongate portions of each slot is located on an outer face of the protective cover and a second of the elongate portions of each radial slot is located on a perimeter side wall of the protective cover.

Still yet another object of the present invention is to provide a new single rotary blade grooming trimmer that offers a safe, painless means to sculpt eyebrows into an arched shape in a manner that does not irritate skin as waxing often can.

Even still another object of the present invention is to provide a new single rotary blade grooming trimmer that has a housing shaped to help greatly enhance the degree of control a user has over the shaping of an eyebrow with the trimmer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
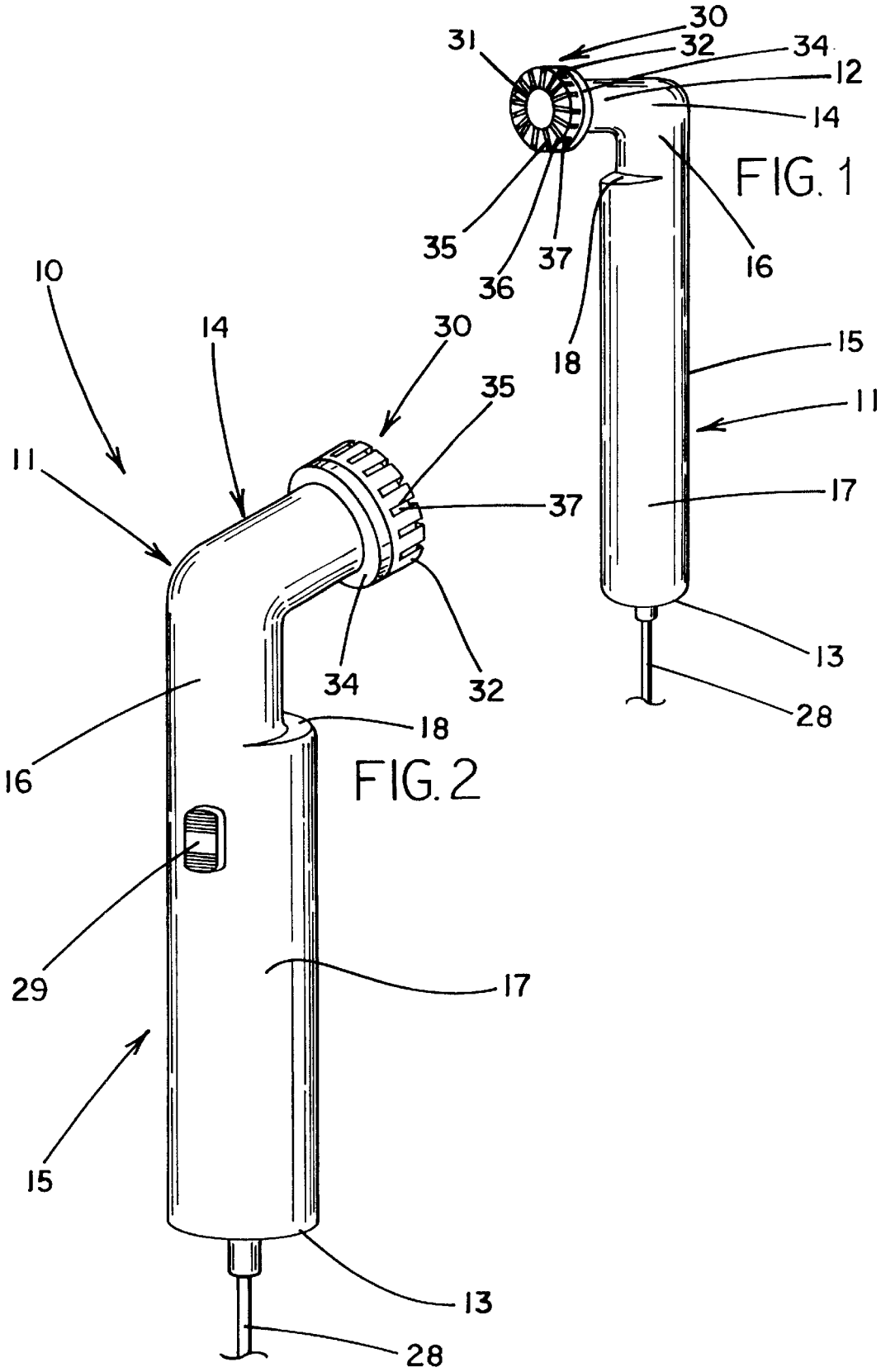
FIG. 1 is a schematic front perspective view of a new single rotary blade grooming trimmer according to the present invention.
FIG. 2 is a schematic back perspective view of the present invention.
Figure 3:
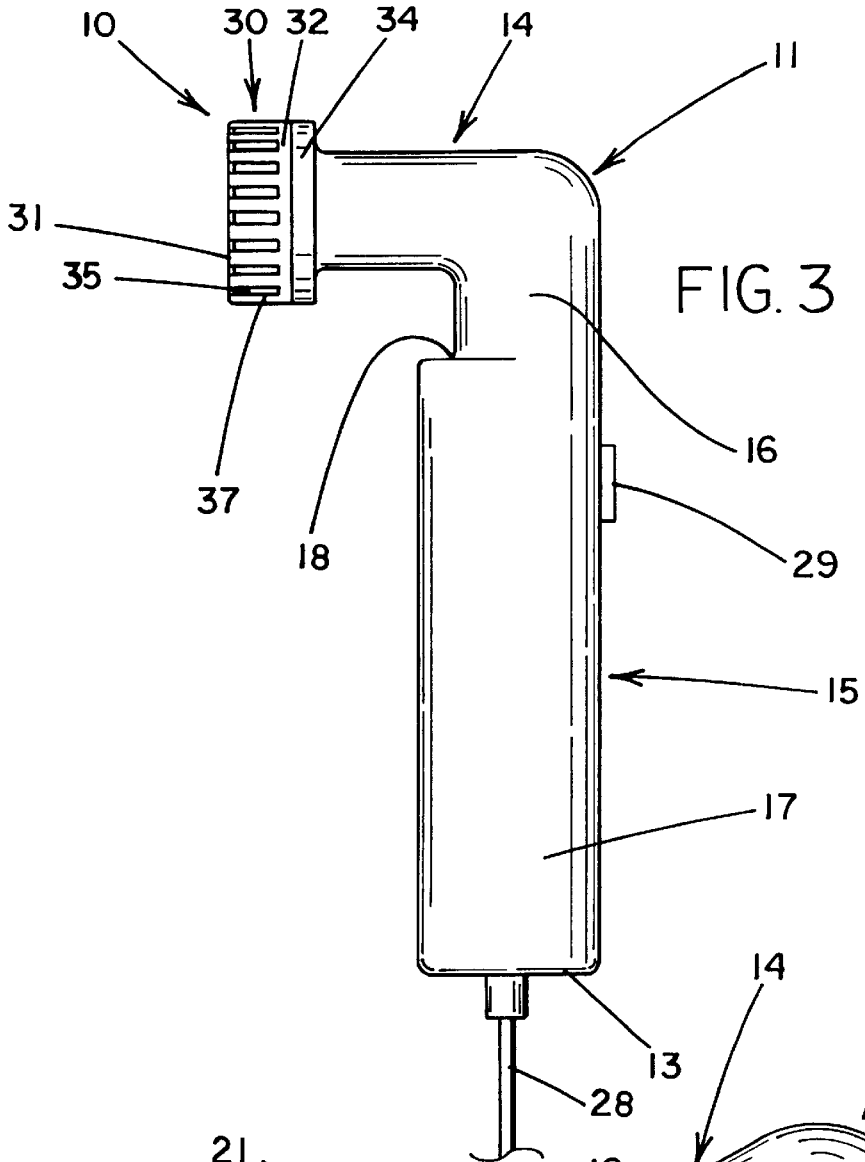
FIG. 3 is a schematic side view of the present invention.
Figure 4:
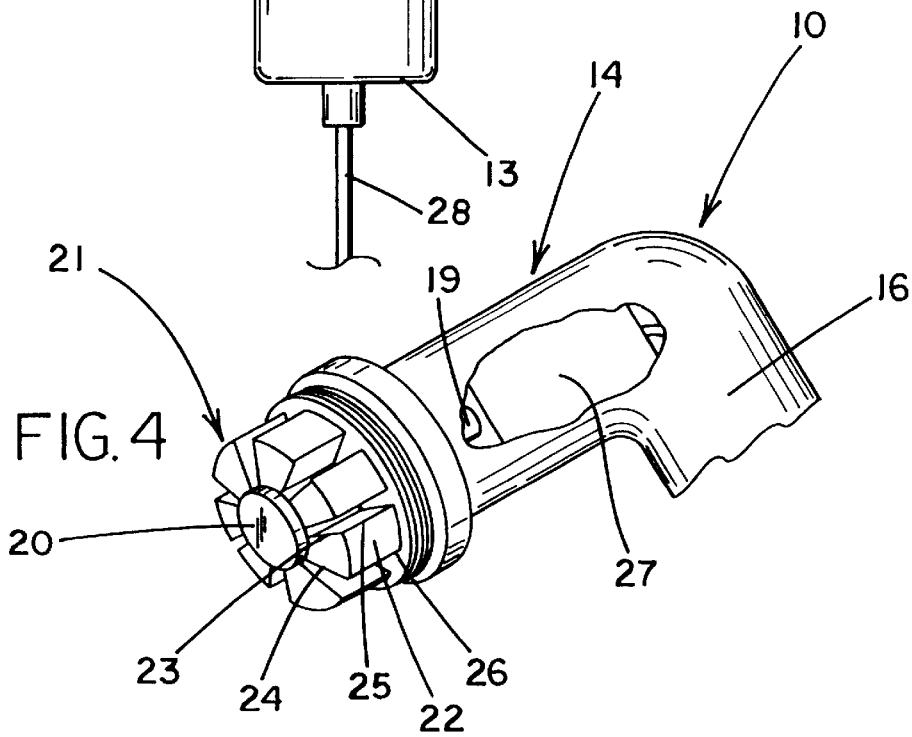
FIG. 4 is a schematic enlarged breakaway front perspective view of the area around the upper portion of the housing of the present invention.

With reference now to the drawings, and in particular to FIGS. 1 through 4 thereof, a new single rotary blade grooming trimmer embodying the principles and concepts of the present invention and generally designated by the reference numeral 10 will be described.

As best illustrated in FIGS. 1 through 4, the single rotary blade grooming trimmer 10 generally comprises a housing with a generally L-shaped configuration having upper and lower ends, and upper and lower portions. The upper end of the housing has a rotatable shaft extending therethrough. A plurality of rotary cutting blades outwardly radiate from the rotatable shaft adjacent an outer end of the rotatable shaft. A motor for rotating the rotatably shaft is disposed the housing. A protective cover substantially covers the cutting blades. The protective cover has a plurality of spaced apart radial slots therethrough with each radial slot comprising a pair of elongate portions preferably of equal lengths. A first of the elongate portions of each slot is located on an outer face of the protective cover and a second of the elongate portions of each radial slot is located on a perimeter side wall of the protective cover.

In closer detail, the single rotary blade grooming trimmer 10 includes a housing 11 having a generally L-shaped configuration with upper and lower ends 12,13, and upper and lower portions 14,15 extending substantially perpendicular to one another. The upper portion of the housing is positioned adjacent the upper end of the housing and the lower portion of the housing is positioned adjacent the lower end of the housing.

The lower portion of the housing has generally cylindrical upper and lower regions 16,17. The upper region of the lower portion is positioned adjacent the upper portion of the housing. The lower region of the lower portion is positioned adjacent the lower end of the housing. The lower region of the lower portion has an outer diameter greater than an outer diameter of the upper region of the lower portion. The upper region of the lower portion also has a longitudinal axis offset from a longitudinal axis of the lower region of the lower portion so that a generally crescent-shaped shoulder 18 is formed between the upper and lower regions of the lower portion. In use, the lower region of the lower portion is designed for grasping with a user's hand to hold the housing.

The upper end of the housing has a single rotatable shaft 19 extending therethrough preferably substantially coaxial with a longitudinal axis of the upper portion of the housing to permit free rotation of the rotatable shaft about an axis of rotation parallel and ideally coaxial to the longitudinal axis of the upper portion of the housing. The rotatable shaft has an outer end 20 outwardly extending from the upper end of the housing.

A plurality of rotary cutting blades 21 outwardly radiate from the rotatable shaft adjacent-the outer end of the rotatable shaft. The cutting blades are designed for cutting hair, especially eyebrow hairs. Preferably each cutting blade has a generally frusta-prism shaped configuration with a generally rectangular outer face 22 interposed between a pair of side faces 23,24 converging towards one another in a direction towards the rotatable shaft. The side faces of each cutting blade each form a cutting edge 25,26 adjacent the front face of the cutting blade for cutting hair in a manner that has a low risk of nicking skin adjacent the hair is cut.

A motor 27 for rotating the rotatably shaft is disposed the housing. Preferably, an elongate flexible conduit 28 is electrically connected to the motor. The flexible conduit is outwardly extended from a center of the lower end of the housing for connecting to an external electrical power supply to supply electrical energy to the motor. A switch 29 is electrically connected to the motor to selectively energize the motor. The switch is preferably mounted to the lower region of the lower portion of the housing adjacent the upper region of the lower portion on a side of the housing opposite the upper end of the housing. This positioning of the switch is ideal for permitting the thumb of the hand of a user grasping the lower region to actuate the switch without has to release their grip on the housing.

A generally cylindrical protective cover 30 substantially covers the cutting blades. The protective cover has a generally circular outer face 31 and a generally cylindrical perimeter wall 32 extending around the outer face of the protective cover. The perimeter side wall of the protective cover is threadably coupled to a threaded portion 33 of the upper, portion of the housing positioned adjacent the upper end of the housing. Preferably, the upper portion of the housing has an outwardly radiating annular stop flange 34 therearound adjacent the threaded portion of the upper portion of the housing. The perimeter side wall of the protective cover has an annular free edge that abuts the stop flange to prevent the protective cover from is too deeply threaded on to the upper end of the housing.

The protective cover has a plurality of spaced apart radial slots 35 therethrough for extending hairs therethrough to permit cutting of the hairs by the cutting blades. The radial slots are preferably spaced apart at substantially equal intervals around the protective cover. Each of the radial slots has a generally L-shaped configuration comprising a pair of elongate portions 36,37. A first 36 of the elongate portions of each slot is located on the outer face of the protective cover and a second 37 of the elongate portions of each radial slot is located on the perimeter side wall of the protective cover.

Preferably, the protective cover-has an outer diameter defined across the perimeter side wall of the protective cover between about ¾ inch and about 1 inch. This range of outer diameters has been found to provide an optimal range for the curvature of the perimeter side wall of the protective cover for optimally cutting eyebrow hairs in a visibly appealing arch shape.

Ideally, the outer diameter of the lower region is between about ¾ inch and about 1 inch to comfortably fit in the hands of most users, especially female users. In this ideal embodiment, the lower portion of the housing preferably has a length defined between the upper portion and the lower end of the housing of about 5 inches with the lower region of the lower portion has a length of about 4 inches to comfortably fit in the hands of most users, especially female users.

Also ideally, the length of the upper portion of the housing is about 2 inches for providing an optimal length for extending the cutting blades away from the housing for optimal maneuvering of the cutting blades by the hand of a user when cutting eyebrow hairs therewith.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A grooming trimmer, comprising:

a housing having a generally L-shaped configuration and comprising upper and lower ends, and upper and lower portions;

said upper end of said housing having a rotatable shaft extending therethrough;

said rotatable shaft having an outer end outwardly extending from said upper end of said housing;

a plurality of rotary cutting blades outwardly radiating from said rotatable shaft adjacent said outer end of said rotatable shaft;

a motor for rotating said rotatably shaft being disposed said housing;

a protective cover substantially covering said cutting blades, said protective cover having an outer face and a perimeter wall extending around said outer face of said protective cover;

said protective cover having a plurality of spaced apart radial slots therethrough, each of said radial slots comprising a pair of elongate portions, a first of said elongate portions of each slot being located on said outer face of said protective cover, a second of said elongate portions of each radial slot being located on said perimeter side wall of said protective cover;

said lower portion of said housing has upper and lower regions, said lower region of said lower portion having an outer diameter greater than an outer diameter of said upper region of said lower portion; and said upper region of said lower portion has a longitudinal axis offset from a longitudinal axis of said lower region of said lower portion such that a generally crescent-shaped shoulder is formed between said upper and lower regions of said lower portion.

2. The grooming trimmer of claim 1, wherein said upper and lower portions of said housing extend substantially perpendicular to one another.

3. The grooming trimmer of claim 1, wherein said perimeter side wall of said protective cover is threadably coupled to a threaded portion of said upper portion of said housing positioned adjacent said upper end of said housing.

4. The grooming trimmer of claim 3, wherein said upper portion of said housing having an outwardly radiating stop flange therearound adjacent said threaded portion of said upper portion of said housing, said perimeter side wall of said protective cover having an annular free edge abutting said stop flange.

5. The grooming trimmer of claim 1, wherein said radial slots are spaced apart at substantially equal intervals around said protective cover.

6. A grooming trimmer, comprising:

a housing having a generally L-shaped configuration and comprising upper and lower ends, and upper and lower portions extending substantially perpendicular to one another, said upper portion of said housing being positioned adjacent said upper end of said housing and said lower portion of said housing being positioned adjacent said lower end of said housing;

said lower portion of said housing having generally cylindrical upper and lower regions, said upper region of said lower portion being positioned adjacent said upper portion of said housing, said lower region of said lower portion being positioned adjacent said said lower end of said housing;

said lower region of said lower portion having an outer diameter greater than an outer diameter of said upper region of said lower portion, said upper region of said lower portion having a longitudinal axis offset from a longitudinal axis of said lower region of said lower portion such that a generally crescent-shaped shoulder is formed between said upper and lower regions of said lower portion;

said upper end of said housing having a rotatable shaft extending therethrough substantially coaxial with a longitudinal axis of said upper portion of said housing;

said rotatable shaft having an outer end outwardly extending from said upper end of said housing;

a plurality of rotary cutting blades outwardly radiating from said rotatable shaft adjacent said outer end of said rotatable shaft;

a motor for rotating said rotatably shaft being disposed said housing;

an elongate flexible conduit for connecting to an external electrical power supply, flexible conduit being outwardly extended from a center of said lower end of said housing, said flexible conduit being electrically connected to said motor;

a generally cylindrical protective cover substantially covering said cutting blades, said protective cover having a generally circular outer face and a generally cylindrical perimeter wall extending around said outer face of said protective cover;

said perimeter side wall of said protective cover being threadably coupled to a threaded portion of said upper portion of said housing positioned adjacent said upper end of said housing;

said upper portion of said housing having an outwardly radiating annular stop flange therearound adjacent said threaded portion of said upper portion of said housing, said perimeter side wall of said protective cover having an annular free edge abutting said stop flange;

said protective cover having a plurality of spaced apart radial slots therethrough for extending hairs therethrough to permit cutting of the hairs by said cutting blades, said radial slots being spaced apart at substantially equal intervals around said protective cover;

each of said radial slots having a generally L-shaped configuration comprising a pair of elongate portions, a first of said elongate portions of each slot being located on said outer face of said protective cover, a second of said elongate portions of each radial slot being located on said perimeter side wall of said protective cover; and said protective cover having an outer diameter defined across said perimeter side wall of said protective cover between about ¾ inch and about 1 inch.

7. A grooming trimmer, comprising:

a housing having a generally L-shaped configuration and comprising upper and lower ends, and upper and lower portions;

said upper end of said housing having a rotatable shaft extending therethrough;

said rotatable shaft having an outer end outwardly extending from said upper end of said housing;

a plurality of rotary cutting blades outwardly radiating from said rotatable shaft adjacent said outer end of said rotatable shaft;

a motor for rotating said rotatably shaft being disposed said housing;

a protective cover substantially covering said cutting blades, said protective cover having an outer face and a perimeter wall extending around said outer face of said protective cover;

said protective cover having a plurality of spaced apart radial slots therethrough, each of said radial slots comprising a pair of elongate portions, a first of said elongate portions of each slot being located on said outer face of said protective cover, a second of said elongate portions of each radial slot being located on said perimeter side wall of said protective cover;

said perimeter side wall of said protective cover is threadably coupled to a threaded portion of said upper portion of said housing positioned adjacent said upper end of said housing; and said upper portion of said housing having an outwardly radiating stop flange therearound adjacent said threaded portion of said upper portion of said housing, said perimeter side wall of said protective cover having an annular free edge abutting said stop flange.

8. The grooming trimmer of claim 7, wherein said upper and lower portions of said housing extend substantially perpendicular to one another.

9. The grooming trimmer of claim 7, wherein said lower portion of said housing has upper and lower regions, said lower region of said lower portion having an outer diameter greater than an outer diameter of said upper region of said lower portion.

10. The grooming trimmer of claim 7, wherein said radial slots are spaced apart at substantially equal intervals around said protective cover.

* * * * *